US005823357A

United States Patent [19]

Sieradzki et al.

[11] Patent Number: 5,823,357

[45] Date of Patent: Oct. 20, 1998

[54] AUTOMATED WHEEL SORTING SYSTEM AND METHOD

[75] Inventors: Christopher Z. Sieradzki, Monee; Jaime F. Pozo, Clarendon Hills, both of Ill.

[73] Assignee: AMSTED Industries Incorporated, Chicago, Ill.

[21] Appl. No.: 893,695

[22] Filed: Jul. 11, 1997

[51] Int. Cl.[6] ..... B07C 7/04

[52] U.S. Cl. ..... 209/703; 205/702; 205/659; 205/942; 414/426; 414/910; 414/908

[58] Field of Search ..... 209/702, 703, 209/659, 942; 414/426, 910, 908

[56] References Cited

U.S. PATENT DOCUMENTS

| | | | |
|---|---|---|---|
| 4,645,401 | 2/1987 | Hopkins et al. | 414/908 |
| 4,773,810 | 9/1988 | Nishimura et al. | 414/908 |
| 5,215,424 | 6/1993 | Gearin et al. | 414/908 |
| 5,287,895 | 2/1994 | Raaijmakers et al. | 414/908 |

FOREIGN PATENT DOCUMENTS

| | | | |
|---|---|---|---|
| 52-7558 | 1/1977 | Japan | 414/908 |

*Primary Examiner*—William E. Terrell
*Assistant Examiner*—Joe Dillon, Jr.
*Attorney, Agent, or Firm*—Edward J. Brosius; F. S. Gregorczyk; Stephen J. Manich

[57] ABSTRACT

The invention provides a method and system for automated sorting or articles such as railroad wheels. After the wheels are inspected and designated as fitting a particular category, the wheels are moved to a transfer car and the wheel and transfer car are moved to a wheel pick up station, where an overhead hoist awaits. As the wheel and transfer car are moved, a hook portion of the hoist is received in the wheel axles hole. The hoist raises the wheel out of the transfer car and then the hoist and wheel move laterally to a wheel drop off station corresponding with the category of the wheel. A shuttle car with an empty wheel receiving slots is below each wheel drop off station. The hoist lowers the wheel into the aligned wheel slot of the appropriate shuttle car for that category of wheel. After the wheel is deposited in the slot, the shuttle car indexes away from the hoist, freeing the wheel and hoist from one another. The hoist is then raised and returned to the wheel pick up station. The process continues until it is desired to remove a group of sorted wheels from one of the shuttle cars. The sorted wheels may be lifted out of each shuttle car as a group and transferred to a desired location.

23 Claims, 10 Drawing Sheets

AUTOMATED WHEEL SORTING SYSTEM AND METHOD

FIELD OF THE INVENTION

The present invention relates to sorting operations in manufacturing, and more particularly to sorting heavy articles into groups of like articles.

BACKGROUND OF THE INVENTION

In manufacturing, it is frequently necessary to inspect articles being produced, and to then sort the articles into groups of like articles. Often, it is necessary to store the sorted articles in these groups for further processing at a later time. Such movement and storage can be problematic when the articles are heavy or otherwise difficult to maneuver, and can be especially arduous when the articles are moving through a production line.

The problems of moving, sorting and storing articles that have been identified as having certain characteristics has been especially burdensome in the manufacture of cast steel railroad wheels. Typically, wheels in a manufacturing line reach the point where they are inspected and measured. Due to various factors, the wheels may have slight differences in characteristics such as their circumferences. For maximum performance, wheels should be matched so that the pair of wheels on the ends of each axle have closely similar circumferences. Accordingly, it is desirable to sort wheels as they are measured so that wheels with similar circumferences are grouped together. Such wheels may need to be sorted according to other characteristics as well. For example, during inspection it may become apparent that some wheels need additional finishing, or that some may need to be scrapped or further tested or inspected. It is necessary to sort these wheels into groups as well. During manufacturing, it may be difficult to direct the classified wheels to the appropriate group while maintaining efficient production schedules. To use a lift truck for each individual wheel is inefficient and could create traffic and safety problems or could slow down the production line. In the past, the sorting operation has been done by hand, with a worker rolling an individual wheel along the ground to a wheel grouping in a designated area. With cast steel wheels weighing on the order of hundreds of pounds, hand-rolling the wheels can involve the risk of injury to the workers. Hand-rolling can be inefficient as well, slowing production and creating a bottle-neck in the production line.

SUMMARY OF THE INVENTION

The present invention is directed to increasing the safety and efficiency of production, particularly in the manufacture of heavy articles such as cast steel railroad wheels. Instead of manually rolling the wheels after inspection, the present invention provides for automated sorting of the wheels into groups. The sorted wheels may be stored in these groups until a sufficient number are present for efficient movement of the group of wheels with a lift truck, so that production efficiency is maintained. Equipment is used to lift and move the wheels into an appropriate group without the need to manually roll the wheel to the group, increasing the safety of the operation.

In one aspect the present invention provides a method of sorting articles into groups of like articles. The method includes the step of providing an inspection station for inspecting and determining the category of the articles. A pick-up station spaced from the inspection station is also provided, along with a transfer device for moving the articles to the pick-up station. A plurality of drop-off stations are provided spaced from the pick-up station and inspection station. A plurality of shuttle cars are also provided. Each shuttle car has a plurality of receiving stations for receiving one of the articles and each shuttle car is associated with one drop off station. Each shuttle car and associated drop off station correspond with a category of articles. A carriage device is provided for moving each article from the pick-up station to one of the drop off stations. The method also includes the step of aligning a single receiving station of each shuttle car with each drop off station. An article is inspected at the inspection station, and the appropriate category for the inspected article is determined. The article is moved from the inspection station to the transfer device. The article and transfer device are moved to the pick-up station. The article is removed from the transfer device at the pick up station and moved to the drop off station corresponding with the category for the article. The article is deposited at the drop off station in the receiving station of the shuttle car aligned with the drop off station and corresponding with the category of the article. The shuttle car is moved so that an empty receiving station is aligned with the drop off station.

In another aspect the present invention provides a system for sorting articles into groups of like articles. The system includes an inspection station for determining the category to which an article belongs. The system also includes a pick up station spaced from the inspection station. A plurality of drop off stations are laterally spaced from the pick up station. A movable transfer car is used for moving an article to the pick up station. A carriage system is include in the system. The carriage system includes a hoist laterally movable between the pick up station and drop off stations. The hoist has a vertically movable portion for raising an article out of the transfer car at the pick up station. The system includes a plurality of shuttle cars spaced from the inspection station and pick up station. Each shuttle car is associated with one drop off station, and each shuttle car has a plurality of receiving stations for receiving sorted articles. One receiving station in each shuttle car is aligned with each drop off station so that the vertically movable portion of the hoist may be lowered to deposit an article in the receiving station. The system includes means for moving the transfer device from the inspection station to the pick up station, means for moving the shuttle cars so that each receiving station may be aligned with the corresponding carriage system drop off station, means for moving the hoist laterally between the pick-up station and the drop off stations, means for raising and lowering the vertically movable portion of the hoist.

In another aspect the present invention provides a system for sorting railroad wheel into groups of like wheels. The wheels are of the type having outer treads and hubs with axle holes. The system includes an inspection station for determining the category to which a wheel belongs. The inspection station has a rail for supporting a tread of the wheel. A transfer station is adjacent the inspection station. A pick up station is spaced from the inspection station and transfer station. A plurality of drop off stations are spaced from the inspection station, transfer station and pick up station. The system includes a transfer car movable between the transfer station and the pick-up station. The transfer car has a rail aligned with the rail of the inspection station when the transfer car is at the transfer station so that a wheel may be rolled on its tread 31 from the rail of the inspection station onto the rail of the transfer car. A carriage system is provided, including a hoist for raising a wheel out of the transfer car at the pick up station. The carriage system has a substantially horizontal beam spanning the distance between the pick up station and all of the drop off stations. The beam is positioned above the pick up station. The hoist is laterally movable on the beam between the pick up station and drop off stations. The hoist includes a vertically movable portion movable between positions nearer to and farther from the beam. A plurality of shuttle cars are spaced from the inspection station, the transfer station and the pick up station. Each shuttle car is associated with one drop off station for the carriage system. Each shuttle car has a plurality of receiving stations for receiving sorted wheels. One receiving station in each shuttle car is aligned with each carriage system drop off station so that the hoist may be lowered to deposit a wheel in the receiving station. The system includes means for moving the transfer car from the transfer station to the pick up station, means for moving the shuttle cars so that each receiving station may be aligned with the corresponding carriage system drop off station, means for moving the hoist between the pick-up station and the drop off stations, and means for raising and lowering the vertically movable portion of the hoist.

DETAILED DESCRIPTION

Figure 1:
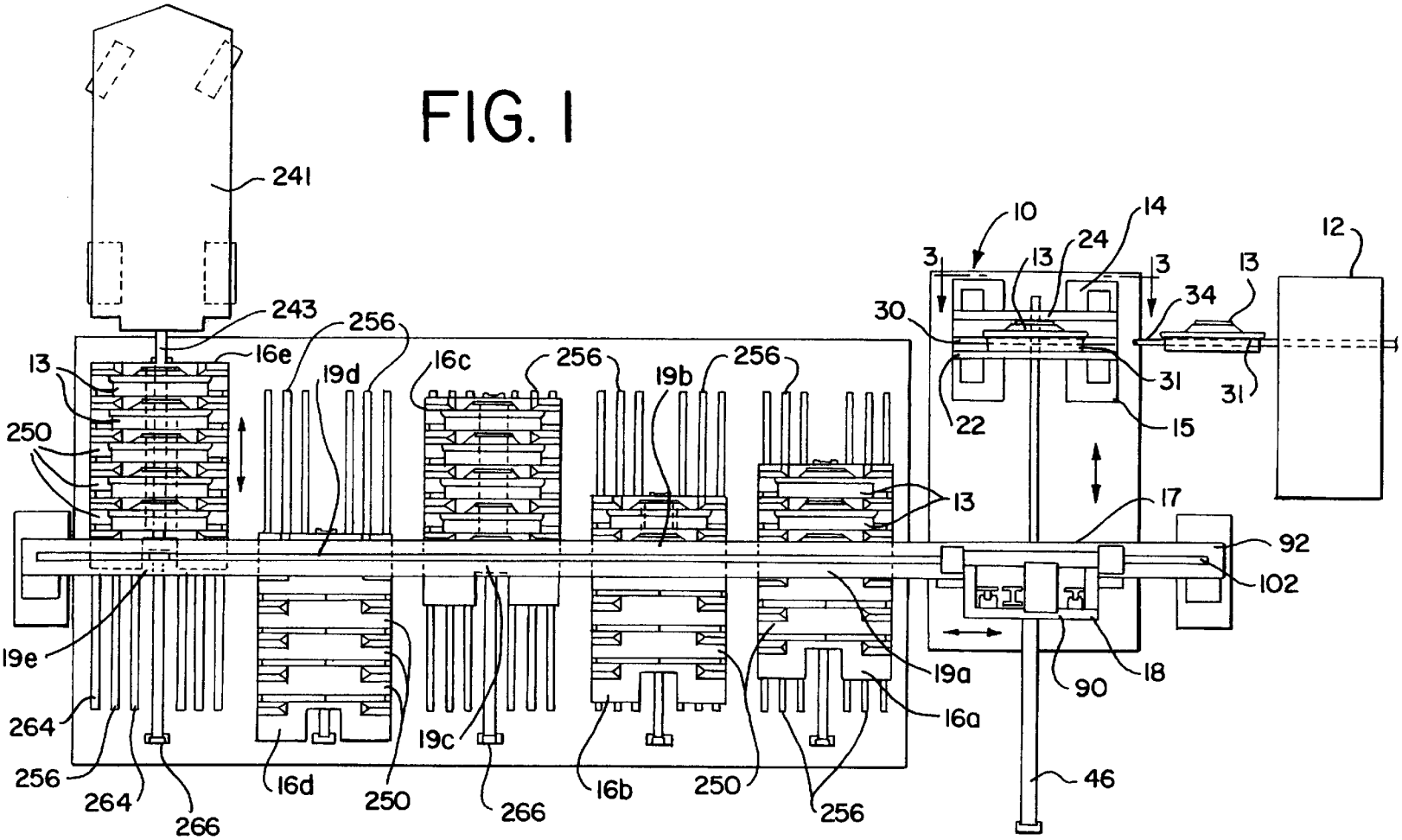
FIG. 1 is a top plan view of an embodiment of an automated wheel sorting system of the present invention.

A system 10 for automated sorting of railroad wheels is shown in the accompanying drawings. The illustrated system 10 comprises several interdependent parts at the end of the wheel inspection station 12. The parts of the illustrated system include a wheel transfer car 14, a plurality of wheel shuttle cars 16*a*–16*e*, and a wheel carriage system 18. The wheel transfer car 14 moves each wheel one at a time from the final inspection station 12 to a position under the wheel carriage system 18. From the wheel transfer car 14, the wheel carriage system 18 moves each wheel to one of the wheel shuttle cars 16. Each wheel shuttle car 16 corresponds with a group or category of wheels, and the automated sorting system includes computer controls so that the operator may direct the wheel carriage system 18 to place each sorted wheel in an appropriate shuttle car 16. When each wheel shuttle car 16 is full of sorted wheels, the group of sorted wheels may be picked up and moved to a desired storage location.

At a typical final wheel inspection station 12, the wheels may already have been tested for conformity with standards, such as through black light inspection or other inspection, and may have been marked for further analysis or scrapping. At the final inspection station, the wheel circumference may be measured and marked on the wheel, as well as other measurements. Particular finishing operations for particular wheels may also be designated and marked on the wheel. At this stage of manufacturing, it is generally desirable that wheels with similar characteristics or similar ultimate destinations be sorted and grouped, the groups of wheels typically being stored for transport to another destination in the plant.

Typical prior art plant operations have required that a worker manually roll each wheel to a particular location for wheels with those characteristics or having the same destination. Manual rolling of the wheels is inefficient and risks injury to the workers from the heavy wheels falling or rolling onto their feet, for example.

Rather than manual rolling of the wheels from the final inspection station 12, the present invention first provides a wheel transfer car 14 as illustrated in FIGS. 1–5. The wheel transfer car 14 serves to move the wheel from a wheel transfer station or position 15 aligned with and adjacent to the final inspection station 12 to a wheel pick up station or position 17 beneath the wheel carriage system 18, where the wheel can be picked up and moved to one of a plurality of wheel drop off stations or positions 19. At the appropriate wheel drop off station 19, the carriage system may lower the wheel into one of the plurality of slots or receiving stations or positions 250 in each shuttle car 16. Each wheel shuttle car 16 carries a group of similar wheels.

Figure 3:
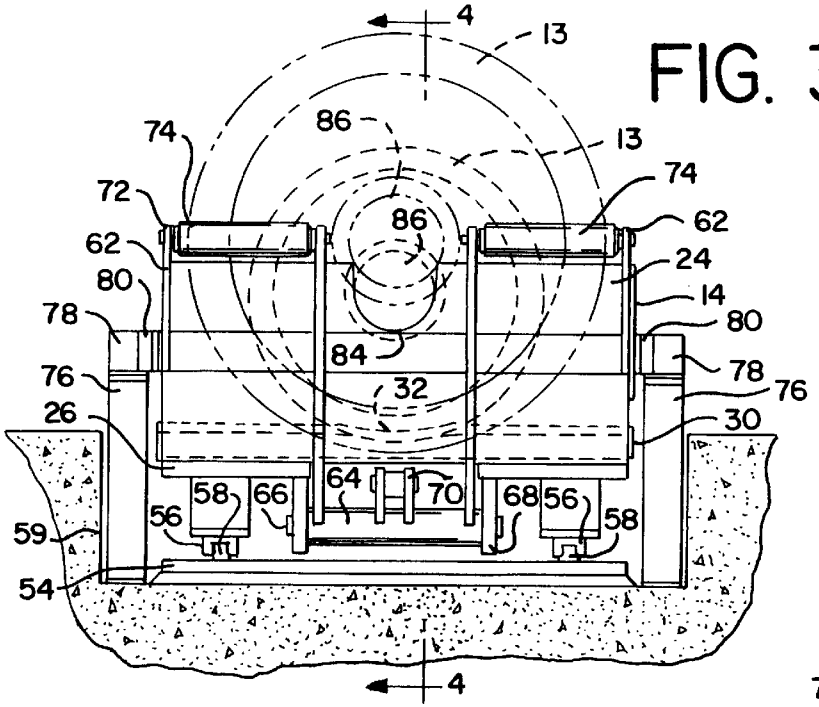
FIG. 3 is an end view of the wheel transfer car of the system of FIGS. 1–2, with two different diameter wheels shown in phantom.
Figure 4:
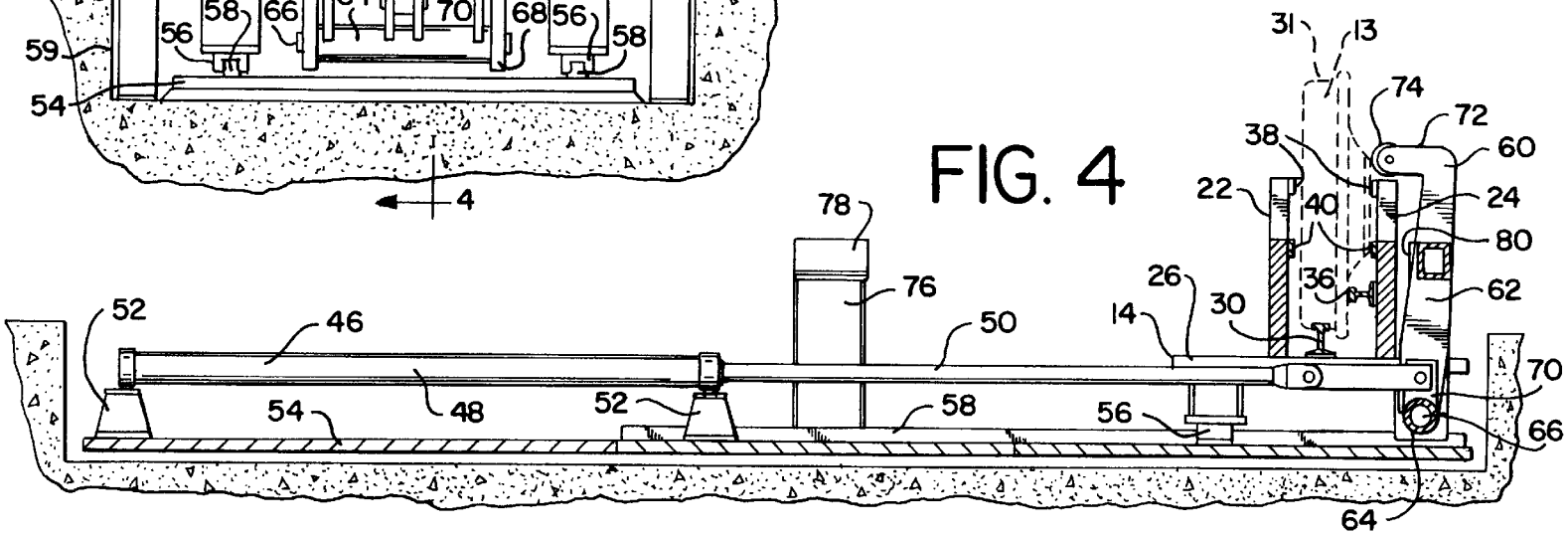
FIG. 4 is a cross-section of the wheel transfer car of FIG. 3, taken along line 4—4 of FIG. 3.
Figure 5:
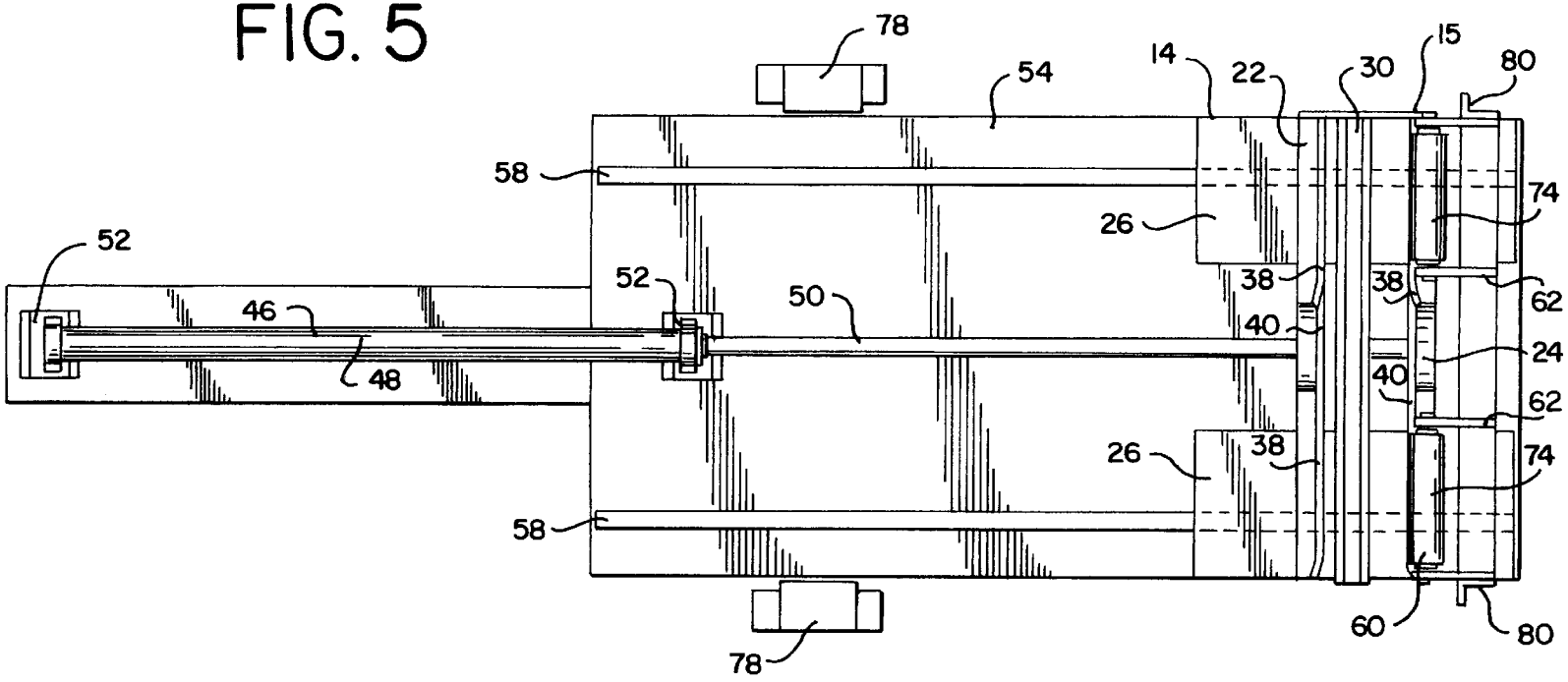
FIG. 5 is a top plan view of the wheel transfer car of FIG. 3.

The illustrated wheel transfer device or car 14 serves to hold and move the wheels 13 from the transfer station 15 to the wheel pick up station 17. As shown in FIGS. 3–5, the transfer car 14 contains a wheel frame comprising front vertical frame member 22 and rear vertical frame member 24 and a pair of spaced horizontal base frame members 26. The front and rear frame members 22, 24 are attached to the base frame members by any suitable means, such as by welding. The front and rear frame members 22, 24 are spaced apart a distance sufficient to receive a wheel 13 as shown in FIG. 4. A main rail 30 is supported on the base plates 26, and is attached to the plates such as by bolts or the like. As shown in FIG. 3, the main rail has a dip 32 at its center. When the transfer car 14 is positioned at the wheel transfer station 15, as shown in FIG. 1, the transfer car main rail 30 is aligned with a production line rail 34 so that the wheel may be easily rolled onto the transfer car rail from the production line rail, with the tread 31 of the wheel supported on the transfer car rail. When the wheel rolls to the dip 32 at the center of the transfer car main rail 30, the wheel is stabilized against any further rolling by gravity. Thus, the wheel 13 may be rolled from the final inspection station onto the wheel transfer car 14.

As shown in FIG. 4, the wheel 13 is further supported in the wheel transfer car by a guard rail 36 extending along the length of the rear frame member 24 toward the front frame member 22. To limit wear on the front and rear frame members 22, 24, the frame may also have an upper wear bar 38 and a lower wear bar 40 on each of the front and rear frame members 22, 24. Thus, as wear occurs from the continued use of the transfer car, the wear bars 38, 40 should wear out first, providing for a less costly and easier replacement compared to replacement of the frame members 22, 24. As shown in FIG. 5, the wear bars 38, 40 generally are bent outwardly at the leading edges that receive the wheels to ensure that there is no interference between the entering wheel 13 and the wear bars 38, 40.

The illustrated wheel transfer car 14 is moved between two alternate stations or positions: the wheel transfer position 15, as shown in FIGS. 1 and 5, where the transfer car main rail 30 is aligned with the production rail 34 to receive a wheel 13 from the final inspection station 12, and the wheel pick up station or position 17 under the wheel carriage system 18. Means for moving 46 the transfer device or car are provided to move the wheel transfer car between these two positions 15, 17.

The illustrated transfer car moving means 46 comprises an hydraulic cylinder 48 with a telescoping rod 50 that is connected to the wheel transfer car 14. The hydraulic cylinder 48 is mounted on a pair of cylinder mounts 52 that may be mounted on a base plate. The hydraulic cylinder 48 receives one end of the telescoping rod 50, which may telescope into and out of the cylinder 48; the other end of the rod 50 is attached to the transfer car 14 so that the car 14 is moved between the wheel transfer station 15 and wheel pick up station 17 as the transfer car moving means 46 is operated. A suitable moving means for use with the present invention is available from Carter Controls, Inc. of Rockford, Ill.; this moving means has a hydraulic cylinder with a 3¼ inch bore, a 63 inch net stroke and a 65 inch gross stroke, a 1¾ inch rod, Model "CBJJ", and end cushions. It should be understood that the present invention is not limited to this particular moving means, and is not limited to hydraulic moving systems. Other devices may be used to move the transfer car between its two positions; for example, a linear drive mechanism or belt drive mechanism.

For ease of movement of the transfer car, the illustrated transfer car moving means 46 also includes four runner blocks 56. Two runner blocks are horizontally aligned on and attached to each horizontal frame member 24 of the wheel transfer car. Two runner blocks 56 ride on a guide rail 58 mounted to a base plate 54. Two such guide rails 58 are provided in the illustrated embodiment, running parallel to each other and to the telescoping rod 50 and hydraulic cylinder 48. The guide rails 58 and runner blocks 56 may comprise linear bearings. Suitable guide rails 58 and runner blocks 56 are available from the Star Linear Systems affiliate of Mannesman Rexroth of Charlotte, N.C. under the designation Star Ball Rail System, Size 45, Accuracy Class "N", reference nos. 1605-404-31 and 1662-414-10, the guide rails each being about 2500 mm long in the illustrated embodiment. It should be understood that this system is identified for purposes of illustration only, and that other means for moving the transfer car may be used and are within the scope of the invention.

Figure 2:
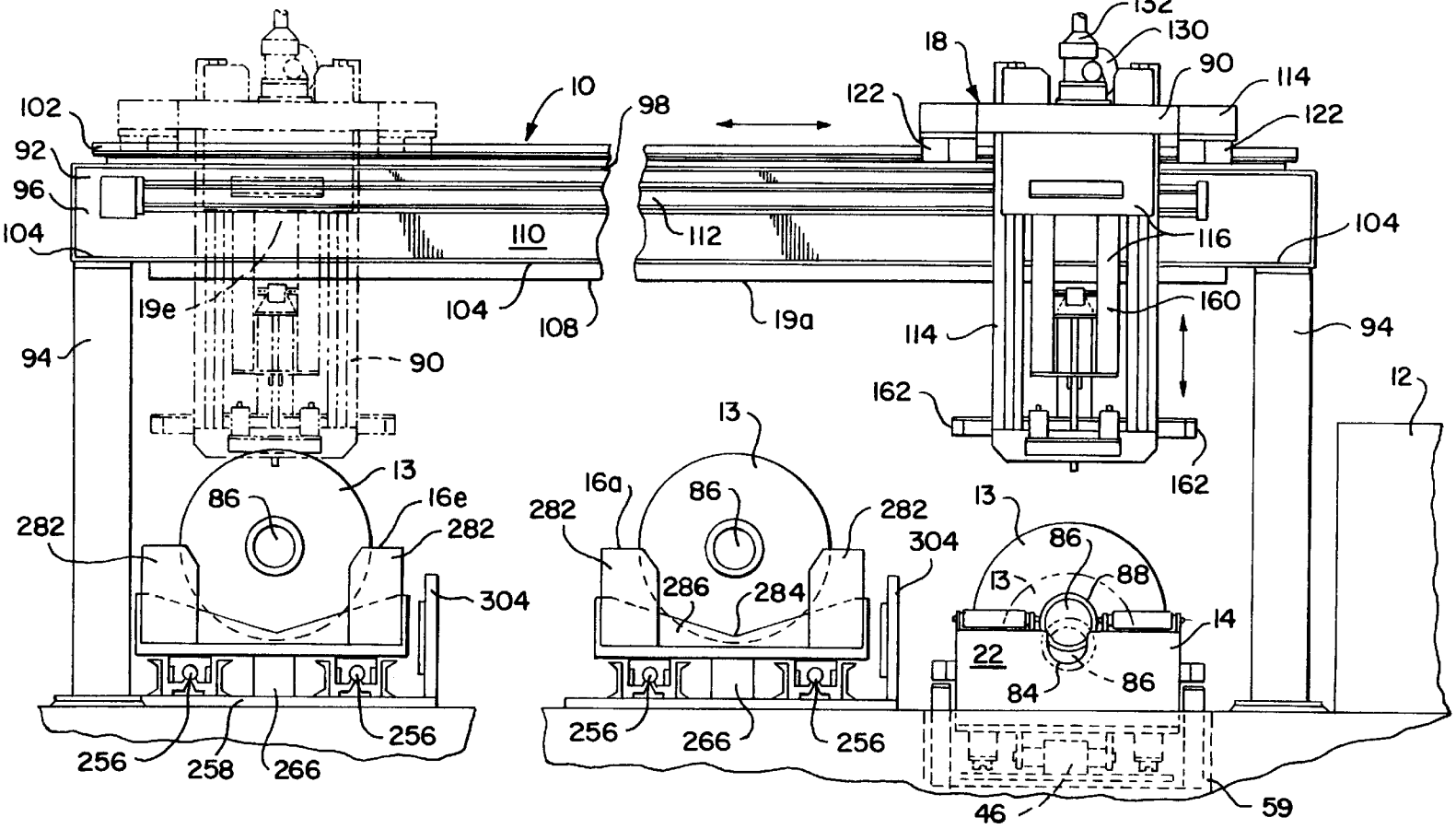
FIG. 2 is an elevation of the automated wheel sorting system of FIG. 1, with parts removed for clarity, with two different diameter wheels, the smaller shown in phantom, in the transfer car.

The base plate 54 may be received in a pit 59 as shown in FIGS. 2–4 so that the main rail 30 is properly aligned vertically with the production line rail 34.

It should be understood that other systems may be used as the transfer car means 46. Any system that moves the wheel and wheel transfer car from the transfer station to the wheel pick up station may be used. It is not necessary that the illustrated rail and runner block system be used, and systems other than the hydraulic system may be used. For example, a motor driven drive belt could be used to move the transfer car. Preferably, movement of the transfer car and wheel are controlled by a central processing unit so that the movement of the various parts of the system are coordinated. Limit switches and position sensors may be used near the transfer car and their input fed into the central processing unit if desired.

In the illustrated embodiment, the wheel transfer car 14 includes a wheel steadying means 60 comprising a pair of clamp arms 62 pivotally connected at one end to the wheel transfer car 14 through a pivot roller 64 on a pivot shaft 66. A pivot bracket 68 depends from the transfer car horizontal base members 24, and the pivot shaft 66 extends between and is connected to the arms of the pivot bracket 68, with the pivot roller 64 riding on the pivot shaft 66 between the arms of the pivot bracket 68. The pivot roller 64 may rotate on the pivot shaft 66, and each clamp arm 62 is connected to the pivot roller 64 by any suitable means such as by welding. At the center of the pivot roller 64, a rod mounting bracket 70 is attached as by welding. The end of the telescoping rod 50 is pivotally attached to the rod mounting bracket 50 so that as the telescoping rod is pulled into the hydraulic cylinder 48, the mounting bracket 70 is pulled, rotating the pivot roller 64 about the pivot shaft 66 and thereby pulling the top ends 72 of the clamp arms 62 toward the wheel 13 in the transfer car. The top ends 72 of the clamp arms 62 have rollers 74 disposed against the wheel 13 so that the wheel 13 may be easily lifted upward out of the transfer car when desired. When the telescoping rod 50 is pushed outward toward the final inspection station 12, the clamp arms 62 are rotated so that they are spaced away from the area where the wheel is to be received.

It should be understood that it is not necessary to use the illustrated clamp arms 62. The transfer car may be operated without any such wheel steadying means.

To ensure that the wheel transfer car reaches its proper wheel pick up station 17 when the telescoping rod is retracted without going beyond that position, stops may be provided. In the illustrated embodiment, a pair of stop stands 76 are mounted within the pit 59, although they may, for example, be mounted on the base plate 54 or elsewhere. The stop stands 76 are beyond the lateral extent of the wheel transfer car front and rear frame members 20, 22, outside of the guide rails 58. Stops 78 are mounted atop the stop stands 76. Lateral extensions 80 are mounted to the transfer car 14. The lateral extensions 80 extend outwardly to abut the stops 78 so that they will contact the stops to limit movement of the transfer car.

In case it should be necessary or desirable to remove a wheel 13 from the wheel transfer car 14 with a lift truck having a front lift rod to he inserted into the axle holes in the hub of the wheels, the front and rear vertical frame members 20, 22 may have open mouths or gaps 84 as shown in FIGS. 2 and 3 corresponding in size and position with the axle holes 86 in the wheel hubs 88 so that the lift rod may be inserted into the hole and raised to lift the wheel 13 out of the wheel transfer car 14. The openings 84 in the frame members 20, 22 also correspond in size and position with a hook of a wheel hoist 90 of the wheel carriage system 18 so that the hook may be inserted into the axle hole 86 in the wheel hub 88 for lifting the wheel 13 out of the transfer car 14, as discussed below.

The wheel carriage system 18 is illustrated in FIGS. 1–2, 6–8 and 15–17, and includes the wheel hoist 90 and a carriage main frame 92 on which the wheel hoist 90 is supported for lateral movement between the wheel pick up station or position 17 and all of the wheel drop off stations or positions 19*a*–19*e*. At least one wheel receiving station 250 or slot of each shuttle car 16*a*–16*e* is positioned beneath the carriage main frame 92 at each drop off station 19*a*–19*e*. Thus, wheels may be moved from the wheel transfer car 14 to the shuttle car 16 corresponding with that category of wheel.

As shown in FIG. 2, the main frame 92 of the illustrated embodiment comprises a pair of I-beam uprights 94 supporting a horizontal beam 96. The horizontal beam 96 may also comprise an I-beam. As shown in FIG. 2, the two uprights 94 are outboard of the transfer car 14 and shuttle cars 16*a*–16*e*. The illustrated uprights 94 are about six feet seven and one-quarter inches from the floor, and are spaced apart, from web to web, a distance of about twenty-eight and three-eighths inches. The horizontal beam 96 is above the wheel pick up station 17 and wheel drop off stations 19*a*–19*e*.

The top flange 98 of the I-beam supports a support rail 100 which in turn supports a shaft 102. The support rail 100 and shaft 102 run substantially the entire length of the horizontal beam 96, substantially centered between the edges of the flange 98, and may be attached to each other and to the top flange 98 by any suitable means. The illustrated support rail 100 may be SR Type #SR-32-PD; the shaft 102 may be a solid 60 case hardened and ground shaft, Class "L", with an overall length of about 28 feet, 2 inches, both available from Thomson Industries, Inc. of Washington, N.Y. This rail is identified for purposes of illustration only; other rails may be used.

Figure 8:
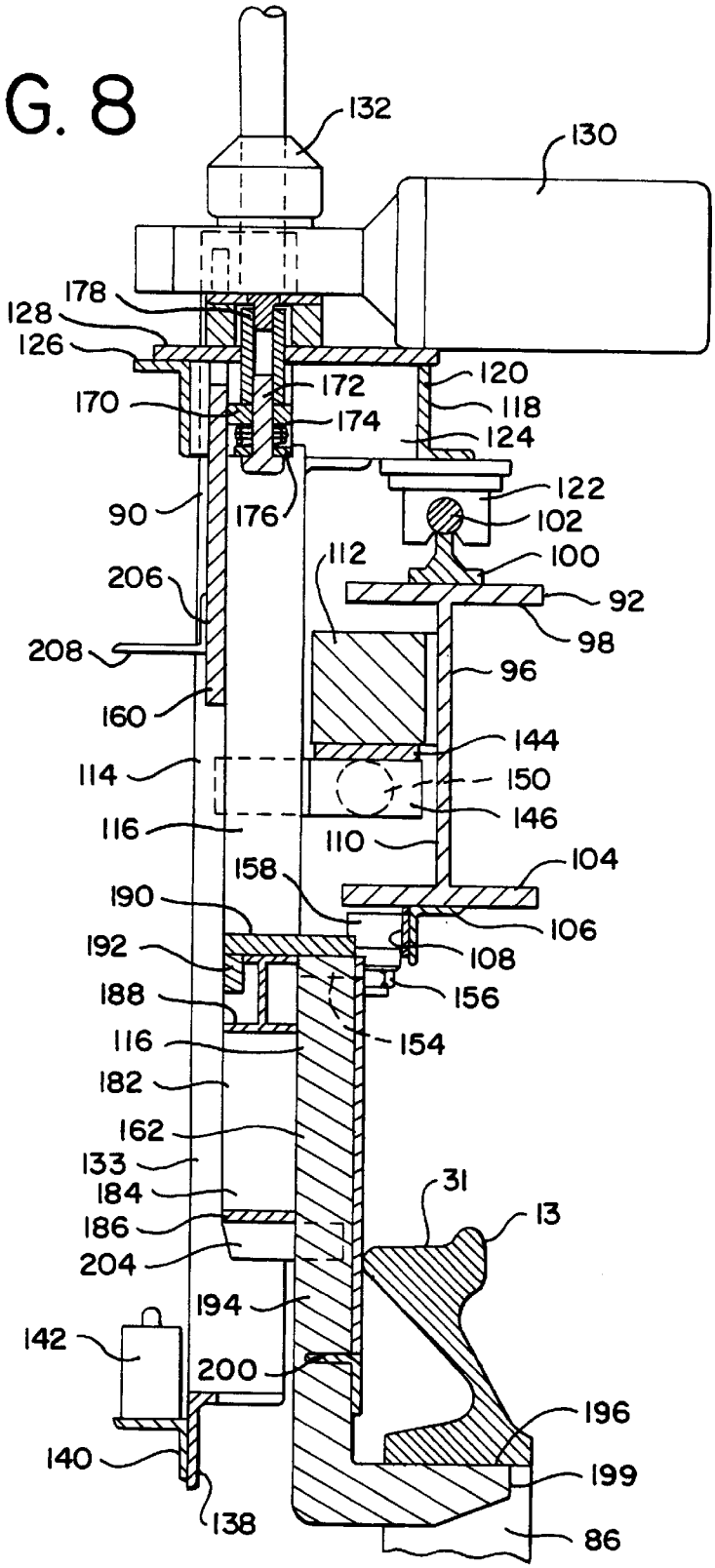
FIG. 8 is a cross-section of the hoist of FIGS. 6–7 taken along line 8—8 of FIG. 7.

As shown in FIG. 2, the bottom flange 104 of the horizontal beam 96 rests on the top ends of the uprights 94. As shown in FIG. 8, an angle 106 is attached to the bottom flange 104 by any suitable means, such as by welding, and has a surface perpendicular to the bottom flange 104 facing away from the fmal inspection station 12. A cam track 108 is attached to the angle 106, along a substantial length of the bottom flange, by bolts or the like, on the side opposite the final inspection 12 and transfer station 15.

On the side of the horizontal beam 96 web 110 facing away from the final inspection station 12, the main frame 92 includes a means 112 for moving the hoist between the pick up and drop off stations. The illustrated hoist moving means comprises a linear drive mechanism 112. The illustrated linear drive mechanism is a linear drive model HLE-150, with twenty-three feet six inches of travel, extended carriage, with one single profile 25:1 ratio parallel gear box, available from Hauser Motion Control, Inc. of Inman, S.C. The illustrated linear drive mechanism is essentially an electric motor and drive belt controlled by a central processing unit. Limit switches and sensors with inputs tied to the central processing unit may be used to assure proper positioning of the hoist 90, and to assure that the hoist has not, for example, coasted beyond the desired stop positions. Other linear drive mechanisms could be used, such as an hydraulic drive. These linear drive mechanisms are two examples of a means for moving the hoist laterally between the pick up station and the drop off stations. It should be understood that other hoist moving means may be used, and that the particular moving means selected will depend in part on the type of article being moved and sorted by the system. Generally, any system that will impart controlled lateral movement to the hoist may be used. For a heavy article such as a cast steel railroad wheel, it is preferred that the moving means accelerate and decelerate smoothly to prevent damage from the momentum of the heavy wheel. It is preferable to control the speed of the hoist's lateral movement, and may be preferred to keep the speed low enough so that the hoist does not coast past the desired stopping position.

As shown in FIGS. 1–2, the wheel hoist device 90 rides back and forth on the main frame horizontal beam 96 between the pick up position 17 over the wheel transfer car 14 to one of the drop off positions 19*a*–19*e* over one of the slots 250 of the wheel shuttle cars 16*a*–16*e*. In the illustrated embodiment, there are five wheel shuttle cars 16*a*–16*e* corresponding with five groups or types of wheels, so the illustrated wheel hoist 90 has a total of six horizontally-spaced positions, as well as vertically-spaced positions for lifting and lowering the wheels 13 out of the transfer car 14 and into the shuttle cars 16.

As shown in FIGS. 2 and 6–8, the illustrated wheel hoist 90 has a vertically fixed portion 114 and a vertically moveable portion 116. Both portions 114, 116 move horizontally along the horizontal beam 96. The vertically fixed portion 114 includes a carriage frame 118 with a horizontal angle 120 overlying a segment of the shaft 102 on the top flange 98 of the horizontal beam 96. Each end of the overlying angle 120 lies above and is connected to a pair of pillow blocks 122 that ride on the shaft 102. The carriage frame also includes a pair of box beam segments 124 extending out from the horizontal overlying angle 120 away from the horizontal beam 96 and away from the final inspection station 12. The box beam segments 124 extend to a horizontal outlying angle segment 126 that is spaced both vertically above and horizontally from the horizontal beam 96. Between the horizontal outlying angle segment 126 and horizontal overlying angle segment 120, a horizontal motor support plate 128 is attached to both angles 120, 126. This horizontal motor support plate 128 supports a motor 130 and ball screw actuator 132. As will be described below, the ball screw actuator 132 is attached to drive the vertically movable portion 116 of the wheel hoist, to raise and lower the portion 116 as desired.

The pillow blocks 122 are ball bushing pillow blocks or roller bearing assemblies that allow the hoist to move laterally on the shaft 102 on the beam 96. Because the beam and shaft could deflect over this span, providing a slightly curved path for the pillow blocks 122, the pillow blocks should be spaced and selected to allow for or accommodate some degree of deflection in the shaft. Suitable pillow blocks are available from Thomson Industries, Inc. of Washington, N.Y. as model number SPB-32-OPN. In the illustrated embodiment, these pillow blocks are spaced apart a distance of about 38 inches between the inside ends of the blocks. This product is identified for purposes of illustration only, and other systems may be used for movement.

Figure 6:
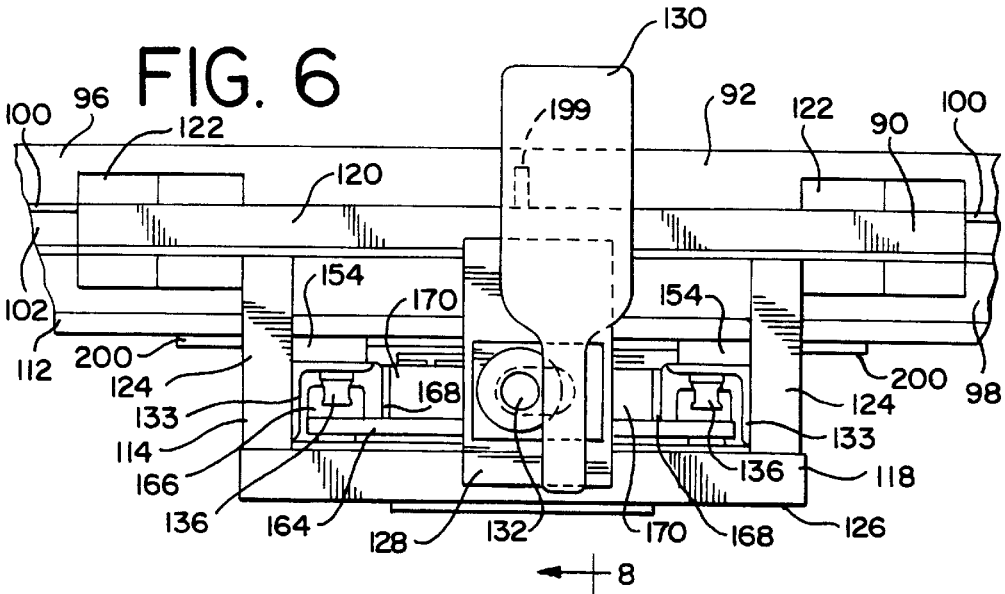
FIG. 6 is a top plan view of the hoist of the system of FIGS. 1–2.
Figure 7:
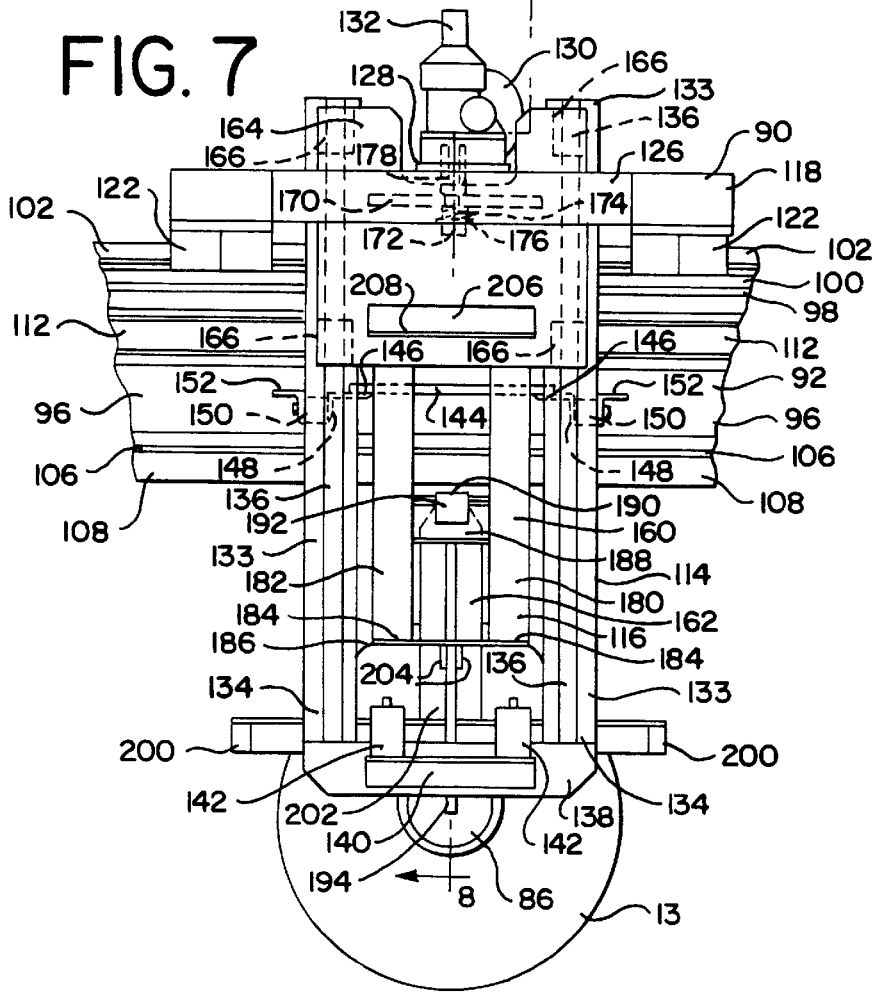
FIG. 7 is a front elevation of the hoist of FIG. 6, with a wheel on the hook.

As shown in FIGS. 6–8, the vertically fixed portion 114 of the wheel hoist 90 also includes a pair of spaced vertical guide rail angle members. The guide rail angle members 133 are positioned between the horizontal outlying segment 126 and the horizontal beam 96 of the main frame, and are spaced from the horizontal beam 96 so that the hoist may move back and forth without interference. The guide rail angle members 133 have one face that is attached to the carriage box beam segments 124. Another face 134 of each guide rail angle member 133 carries a vertically disposed ball rail system guide rail 136 extending the full length of the guide rail angle member. The illustrated guide rails are Size 45×5'1⅛" long accuracy class N, Catalog No. 1605-404-31 available from the Star Linear Systems affiliate of Mannesmann Rexroth of Charlotte, N.C. This product is identified for purposes of illustration only; other systems may be used.

As shown in FIGS. 7–8, at the bottom ends of the guide rail angle members 133, the vertically fixed portion 114 of the hoist has a bottom horizontal angle 138 extending between and connected to each of the guide rail angle members 133. Another shock absorber angle 140 is attached to one face of the bottom horizontal angle 138. The shock absorber angle 140 carries two upward facing, vertically disposed shock absorbers 142.

The vertically fixed portion 114 of the hoist also has a portion indirectly driven by the linear drive mechanism 112 on the horizontal beam 96 so that the hoist can be moved back and forth along the horizontal beam 96. As shown in FIGS. 7–8, in the illustrated embodiment, a horizontal adaptor plate 144 is attached to the bottom side of the linear drive mechanism 112 between the top and bottom flanges 98, 104 of the horizontal beam 96. As shown in FIG. 7, at the two ends of the adaptor plate 144 there are bumper contact angles 146 attached to the adaptor plate 144. The bumper contact angles 146 have outwardly facing vertical contact surfaces 148 inboard of the edges of the vertical guide rail angle members 133. The vertical contact surfaces 148 are in contact or juxtaposed with rubber bumpers 150 outboard of the contact surfaces 148. The rubber bumpers 150 are mounted on bumper mounting angles 152 that are connected to the guide rail angle members 133 of the vertically fixed portion 114 of the hoist. Thus, to impart horizontal movement to the hoist, the linear drive mechanism 112 directly drives the adaptor plate 144 in one direction, and one of the bumper contact angles 146 on the adaptor plate 144 pushes against one of the rubber bumpers 150 on the vertical guide rail angle members 133 on the vertically fixed portion of the hoist, which thereby moves the vertically fixed portion 114 of the hoist in that horizontal direction. Thus, the hoist may be moved indirectly through movement of the adaptor 144 and action of the adaptor against the bumpers 150. The rubber bumpers 150 should provide some cushioning or shock absorption when the loaded hoist is started and stopped. The use of the rubber bumpers instead of a direct metal to metal contact or a direct connection between the adaptor plate and the hoist should improve performance and wear, since otherwise there would be repeated shocks to the hoist structure when the heavy loads were put into motion and stopped.

To limit pendulum swinging of the hoist about an axis through the shaft 102, a pair of shoulders 154 extend horizontally out from the guide rail angle members 133 toward the horizontal beam 96 of the main frame 92. The shoulders 154 are each bolted to a camroll bracket 156 that extends from the shoulders 154 toward the horizontal beam 96 of the main frame 92. Camrolls 158 are mounted on the camroll brackets 156 to rotate about a vertical axis. The weight of the hoist assembly, particularly when carrying a wheel, forces the cam rolls 158 against the cam track 108 on the angle 106 depending from the bottom flange 104 of the horizontal beam 96. The cam rollers and cam track prevent the hoist from rotating off of the shaft while allowing for free horizontal movement of the hoist on the shaft.

The vertically moveable portion 116 of the illustrated hoist 90 is in two parts. A first reciprocating part 160 is mounted to slide up and down on the vertically fixed guide rails 136, and a second hook part 162 comprises a removable hook that hangs from the first reciprocating part 160.

As shown in FIG. 7, the first reciprocating part 160 of the illustrated vertically movable portion 116 of the hoist includes a slide plate 164 carrying four spaced runner blocks 166. The runner blocks 166 ride on the guide rails 136 of the vertically fixed portion 114 of the hoist. The illustrated runner blocks are supplied by the Star Linear Systems affiliate of Mannesmann Rexroth of Charlotte, N.C. as part of the Super Ball Rail System with Self-Aligning Feature, short slimline runner blocks, size 45, catalog number 1662-414-10. This product is identified for purposes of illustration only, and other systems or products may be used. The illustrated runner blocks 166 are arranged in pairs that are vertically aligned. As shown in FIG. 6, inboard of the runner blocks 166 are a pair of vertical plates 168 extending perpendicularly out from the back of the slide plate 164 toward the horizontal beam 96; these vertical plates extend the vertical length of the slide plate 164 and may be welded to the slide plate 164. Extending between the vertical plates 168 is a horizontal lift plate 170 attached to the slide plate 164 by welding. As shown in FIGS. 7–8, the illustrated horizontal lift plate 170 has a central aperture through which a shoulder bolt 172 extends. The head of the shoulder bolt 172 is below the lift plate 170, and a group of Bellville disc springs 174 are interposed between the lift plate 170 and a washer 176 at the head of the shoulder bolt 172. On the top of the lift plate 170, the shoulder bolt 172 is threaded into the bottom end of a coupler 178. The coupler 178 extends through the motor support plate 128 of the vertically fixed portion 114 of the hoist. The top end of the coupler 178 is connected to the bottom end of the ball screw actuator 132. The ball screw actuator 132 is vertically aligned and run by the motor 130 to raise and lower the vertically movable portion 116 of the hoist. With the springs 174 at the juncture of the actuator coupler 178 and the bolt 172, there should be some cushioning of the load to prevent or limit damage to the system.

The ball screw actuator 132 in the illustrated embodiment is a non-rotating type of jack. The motor 130 and voltage for operating the motor provide for relatively slow vertical motion of the vertically movable portion 116 of the hoist, so that there is less likelihood of coasting when the vertically movable portion is stopped. In the illustrated embodiment, the ball screw actuator is set up for inverted travel; a suitable ball screw actuator is Model No. FM98041-36 available from the Duff-Norton Co. of Charlotte, N.C., and is used with a 3 hp motor, 1725 rpm, TEFC, 3 phase 60 hz and brake also available from Duff-Norton. The illustrated ball screw actuator and motor comprise one means for raising and lowering the vertically movable portion of the hoist and is identified for purposes of illustration only; other device may be used for this purpose, and the appropriate devices will depend on the type of article to be sorted. Limit or proximity switches or other types of position sensors may be used in combination with the vertically movable portion 116 of the hoist, and connected to provide input to the central processing unit to assure proper positioning of the vertically movable portion.

As shown in FIGS. 7–8, inboard of the runner blocks 166 on the vertically movable portion 116 are a pair of parallel and spaced vertical I-beams 182 attached to the slide plate 164 and extending down below the edge of the slide plate to ends 184. At the ends 184, the vertical I-beams 182 are connected by a transverse plate 186. Between the ends 184 of the vertical I-beams 182 and the bottom edge of the slide plate 164 there is a horizontal I-beam 188 extending between and connected to the vertical I-beams 182. The horizontal I-beam 188 provides a perch or seat from which the second hook part 162 of the vertically movable portion 116 of the hoist depends.

As shown in FIG. 8, the hook part 162 includes a horizontal plate 190 that rests on top of the horizontal I-beam 188, and a downward extending lip 192 that extends from the horizontal plate 190 down on one side of the horizontal I-beam 188. As shown in FIGS. 7–8, on the opposite side of the horizontal I-beam 188 a rib 194 is attached to the horizontal plate 190 at one end, extending vertically down from the horizontal plate 190 to a horizontal portion 196 extending horizontally outward from the vertical portion 198 beneath the horizontal beam 96 of the frame to a free end 199. Side arms 200 also extend outwardly from both sides of the rib 194. The illustrated vertical rib 194 includes a wear plate 202 attached to the vertical portion 198 of the rib 194. To prevent pendulum swinging of the hook part 162, a pair of spaced plates 204 are attached to the bottom of the transverse plate 186 at the end of the first reciprocating part 160 of the vertically moveable portion 116 of the hoist. The spaced plates 204 extend toward and straddle a part of the hook rib 194 to prevent pendulum swinging of the hook.

By providing a separate hook part 162 without a permanent connection with the remainder of the frame, the illustrated design provides a safety factor in that if there is some misalignment of the hoist in picking up the wheel, rather than breaking part of the hoist structure, the first reciprocating and second hook parts 160, 162 may be separated, reducing the possibility of serious damage to the equipment. Thus, the hook should come loose before the hoist arrangement is broken.

In case of failure of the connection between the vertically movable portion 116 and the ball screw actuator 132, a safety stop angle 206 is attached to the outside of the slide plate 164 as shown in FIGS. 7–8. The safety stop angle 206 has a horizontal surface 208 aligned over the shock absorbers 142 on the vertically fixed portion 114, with apertures aligned over the shock absorber mounting posts. If there is a failure, the vertically movable portion should slide down and be stopped by the shock absorber rather than striking a more delicate or more easily broken part of the hoist structure.

The wheel carriage system 18 delivers a wheel from the wheel transfer car 14 to one of the wheel shuttle cars 16. In the embodiment illustrated in FIGS. 1–2, there are five wheel shuttle cars labeled 16*a*–16*e*. Each wheel shuttle car corresponds with a category or type of wheel, and they are set side-by-side generally below the horizontal beam 96 of the main frame 92 so that the hoist device 90 is capable of delivering a wheel to any one of the five shuttle cars. The operator can designate the particular shuttle car for the particular wheel so that the wheels may be sorted and stored in the shuttle cars 16*a*–16*e*. Each shuttle car has multiple wheel receiving and storing stations or slots 250. Each wheel receiving and storing station or slot 250 is aligned with each drop off station 19.

The shuttle cars index below the horizontal beam 96 so that empty slots 250 are aligned with one of the drop off stations 19*a*–19*e*, positioned below the hoist 90 on the horizontal beam 96 to receive wheels. In the illustrated embodiment, there are five receiving stations or slots in each shuttle car 16, labeled 250*a*–250*e* in FIGS. 9–10. When a shuttle car is empty, the rear slot 250*e* is positioned below the horizontal beam 96 to receive a wheel from the hoist 90. After the rear slot 250*e* has received a wheel, the shuttle car indexes back, positioning the next slot 250*d* below the horizontal beam. After that slot has received a wheel, the shuttle car indexes back, and the next slot 250*c* is positioned below the horizontal beam 96. After slot 250*c* has received a wheel, the shuttle car indexes back again and slot 250*b* is positioned below the horizontal beam. After that slot 250*b* has received a wheel the shuttle car indexes back and the front slot 250*a* is positioned below the horizontal beam. When the shuttle car is filled, a lift truck 241 may be used to remove all the wheels from the shuttle car by inserting its ram or rod 243 through the wheel axle holes as shown in FIG. 1, and the shuttle car may return to the original position. All five of the wheels removed from the shuttle car will have similar characteristics: for example, the measured circumferences of all five wheels may be within a particular tolerance. The filling and indexing may occur in all five shuttle cars, so that one wheel may be directed to one shuttle car and the next wheel to another shuttle car. Thus, at any given moment, different slots of different shuttle cars may be expected to be positioned below the horizontal beam, as illustrated in FIG. 1.

Figure 9:
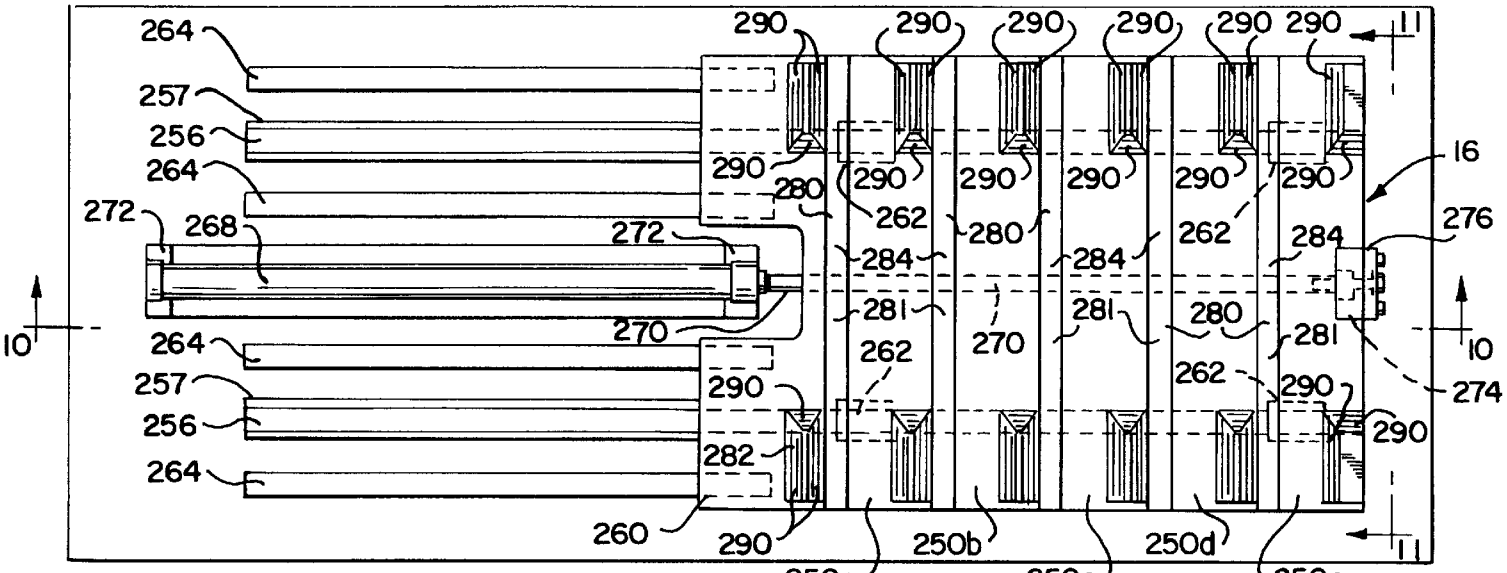
FIG. 9 is a top plan view of one of the shuttle cars of the system of FIGS. 1–2.
Figure 10:
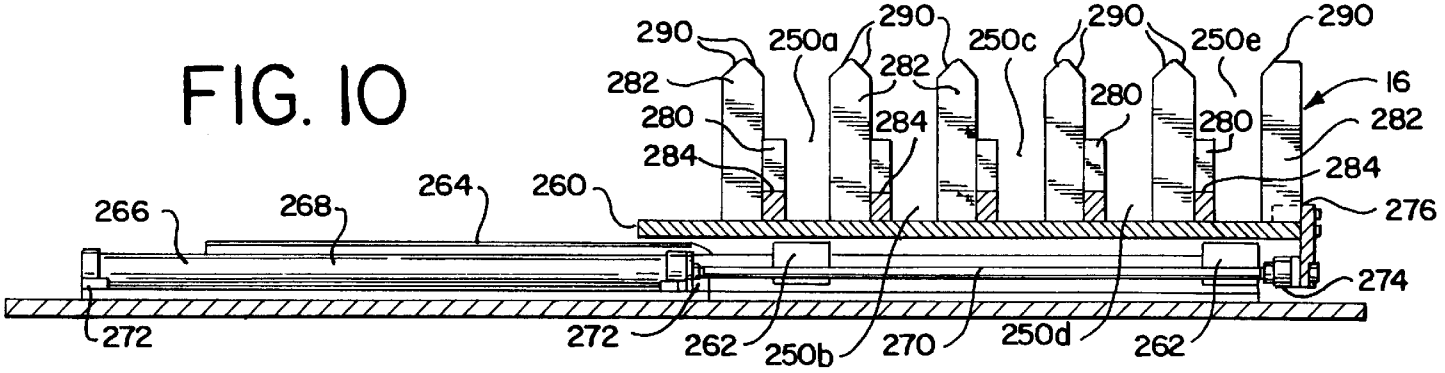
FIG. 10 is a cross-section of the shuttle car of FIG. 9, taken along line 10—10 of FIG. 9.
Figure 11:
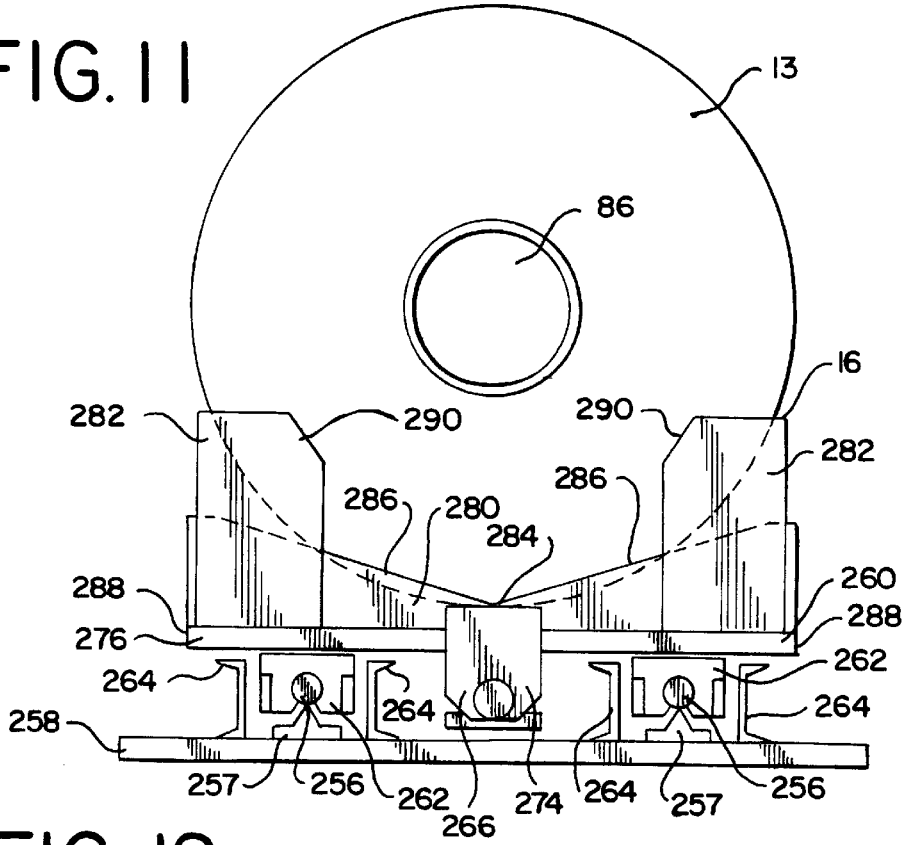
FIG. 11 is an end view of one of the shuttle cars of FIGS. 1–2, shown with a wheel in one of the wheel slots.

As shown in FIGS. 9–11, each shuttle car 16 is carried on a pair of parallel shafts 256 mounted on rails 257 on a flat base 258. The shuttle car 16 has a rectangular base plate 260 parallel to and spaced above the flat base 258 and spaced above the parallel shafts 256. Four pillow blocks 262 are aligned in pairs and attached to the bottom side of the shuttle car base plate 260 to mount the base plate 260 on the parallel shafts 256. The pillow blocks 262 include bearings for unrestricted movement of the shuttle car 16 back and forth on the shafts 256.

As shown in FIG. 1, the shafts 256 are horizontal and positioned vertically below and generally perpendicular to the horizontal beam 96. Each shaft 256 in the illustrated embodiment is long enough to assure that the shuttle car may travel from a position where its back slot 250*e* is below the horizontal beam 96 and the position where its front slot 250*a* is below the horizontal beam 96. The illustrated shafts 256 are ninety-six inches long and two inches in diameter. The illustrated pillow blocks 262 are #P-32-OPN-DSS "Simplicity" with retaining rings and "Pacific" bearings, open series, available from the Pacific Bearing Co. of Rockford, Ill. It should be understood that these structures are provided as examples only, and that other devices may be used to provide guided movement to the shuttle cars; for example, the shuttle cars could be on wheels running on tracks or in recesses.

As shown in FIGS. 1, 9 and 11, to protect the shafts 256 from potential damage, they may be positioned between channels or rails 264 having top surfaces above the level of the shafts 256. The channels or rails 264 may be secured to the flat base 258.

To move the shuttle cars 16, a shuttle car moving system or means 266 is provided. As shown in FIGS. 9–11, the illustrated means for moving the shuttle cars 266 comprises a hydraulic cylinder 268, a telescoping rod 270, cylinder mounts 272 and a coupler mechanism 274. The cylinder mounts 272 position the hydraulic cylinder 268 on the base 258. The telescoping rod 270 has one end received within the hydraulic cylinder and another end attached to the back 276 of the shuttle car at the center of the base plate 260 through the coupler 274. Thus, as the telescoping rod 270 is retracted and extended, the shuttle car 16 may be moved forward and back under the beam 96. The hydraulic cylinder and telescoping rod are preferably controlled so that the shuttle car moves back a distance conforming with the width of one slot 250 after each wheel is received and moves forward to its initial position after the wheels are removed.

A suitable hydraulic cylinder is one having a 2.5 inch diameter bore and a 48 inch stroke, and a gross 50 inch stroke, with a 1.375 inch diameter rod style #4, Model C, with cushioned ends, available from the Des Plaines, Ill., Cylinder Division of the Parker Hannifin Corp. of Cleveland, Ohio;

It should be understood other hydraulic cylinders and rods may be used, and that other means could be used for moving the shuttle car. For example, a group of serially arranged pneumatic devices could be used to move the shuttle car incremental distances; or a linear drive mechanism could be used with limit switches. However, whatever device is used for moving the shuttle car should preferably move slowly enough to avoid shock and stress to the components of the shuttle car due to momentum of the heavy wheels carried by the shuttle cars.

For holding and supporting the wheels, each slot 250 has a beveled wheel support 280 and pairs of spaced uprights 282, as shown in FIGS. 9–11. Each illustrated beveled wheel support comprises a support surface 281 extending across the entire width of the shuttle car, and each support surface has a low point 284 at the center of the shuttle car so that a wheel supported on the wheel support 280 will tend, by gravity, to stay centered on the support. As shown in FIG. 11, the sides 286 of the support 280 extending out from the central low point 284 define an angle of about seventy-three degrees with the vertical in the illustrated embodiment, to ensure that the wheel will not roll out the sides of the slot.

Each of the illustrated shuttle cars has six pairs of spaced upright guides 282, so that each slot is bordered by two pair of upright guides 282. The upright guides 282 serve to hold each wheel vertically within each slot. The heights of the upright guides 282 are great enough to prevent the wheels from tipping over and falling out of the slots, but low enough so as allow for efficient removal of wheels from the shuttle car by the lift truck 241. In the illustrated embodiment, the upright guides are positioned close to the side edges 288 of the shuttle car, and each is about eight inches wide, three and one-half inches thick and spaced apart a distance of about twenty-two inches. Thus, the shuttle is substantially open in the vicinity of the wheel hub for ease of insertion of the lift truck ram or lifter 243, and the spacing and heights of the upright guides allow for support of the wheels while allowing the lift truck to be operated efficiently, that is, the height that the group of wheels must be raised to clear the shuttle car is minimized. The two guides 282 at the back edge 276 of the shuttle car have two beveled surfaces 290, and the remaining guides have three beveled surfaces 290 on their uppermost sides; thus, the uppermost sides of the upright guides along each slot diverge upwardly and outwardly so that wheel being deposited into the slots 250 is guided into position. The guides are spaced apart along the side edges 288 a distance of about six inches. It should be understood that these and other dimensions are given for purposes of illustration only, and that other dimensions, shapes and numbers of parts may be used.

Figure 12:
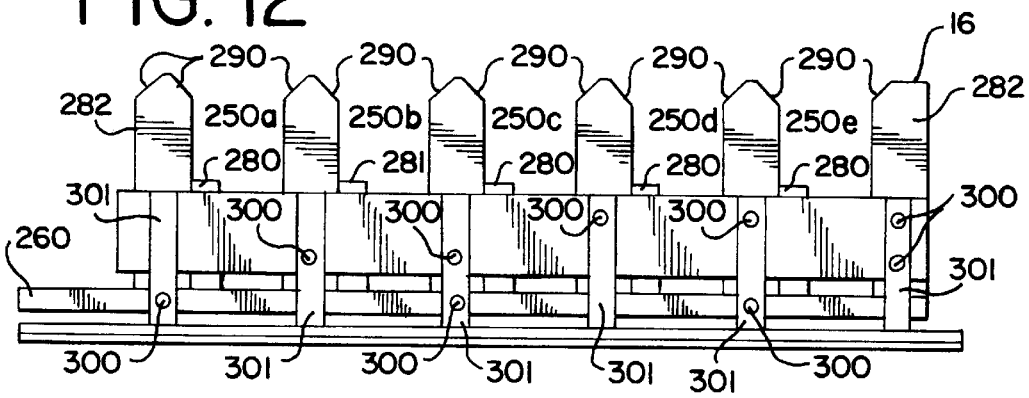
FIG. 12 is a side elevation of a shuttle car, showing targets and target supports for a sensor system for use with the sorting system of FIGS. 1–2.
Figure 13:
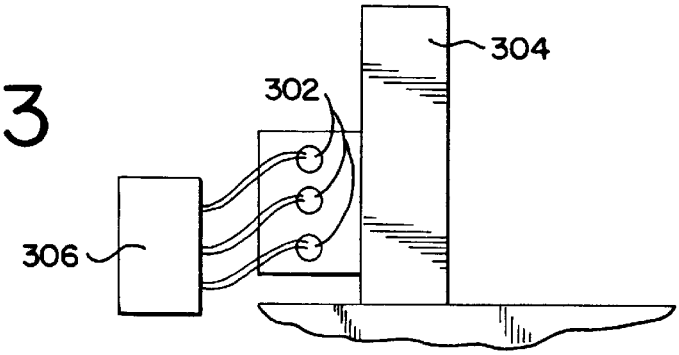
FIG. 13 is a side elevation of a sensor that may be used with the targets of FIG. 12.

To ensure that the shuttle car slots are properly positioned to receive a wheel, a location sensing system may be used. An example of such a system is shown in FIGS. 12–13, where the shuttle car 16 includes a group of targets 300 mounted on target supports 301 attached to the shuttle car near each of the six upright guides 282. As illustrated, a unique configuration of one or two targets 300 is associated with each upright guide 282. Three sensors 302 may be supported by a sensor support 304 alongside the shuttle car, with one group of sensors 302 provided for each shuttle car 16. The sensors 302 and their support may be positioned in the system alongside each shuttle car under the beam 96, for example, aligned with each wheel drop off station 19*a*–19*e* to determine which shuttle receiving station 250 is aligned with each wheel drop off station. Thus, the sensors can detect whether an upright guide is properly positioned across from it and which upright guide 282 is so positioned, and relay this information to a central processing unit 306, or programmable logic element, for display to the operator or for automatic control of movement of the various moving systems 46, 112, 266 of the automated system. As shown in FIGS. 12–13, with three sensors and three available target positions for each target support, the targets can be arranged in six different combinations or configurations to give each target support a unique signature; thus, each upright guide or slot can have a unique signature that can be used for monitoring and control of the system. Suitable targets and sensors are available from Pepperl & Fuchs Inc. of Twinsburg, Ohio under the designation NJ10-30-GM50-WS. This system is identified for purposes of illustration only, and other systems may be used.

Figure 14:
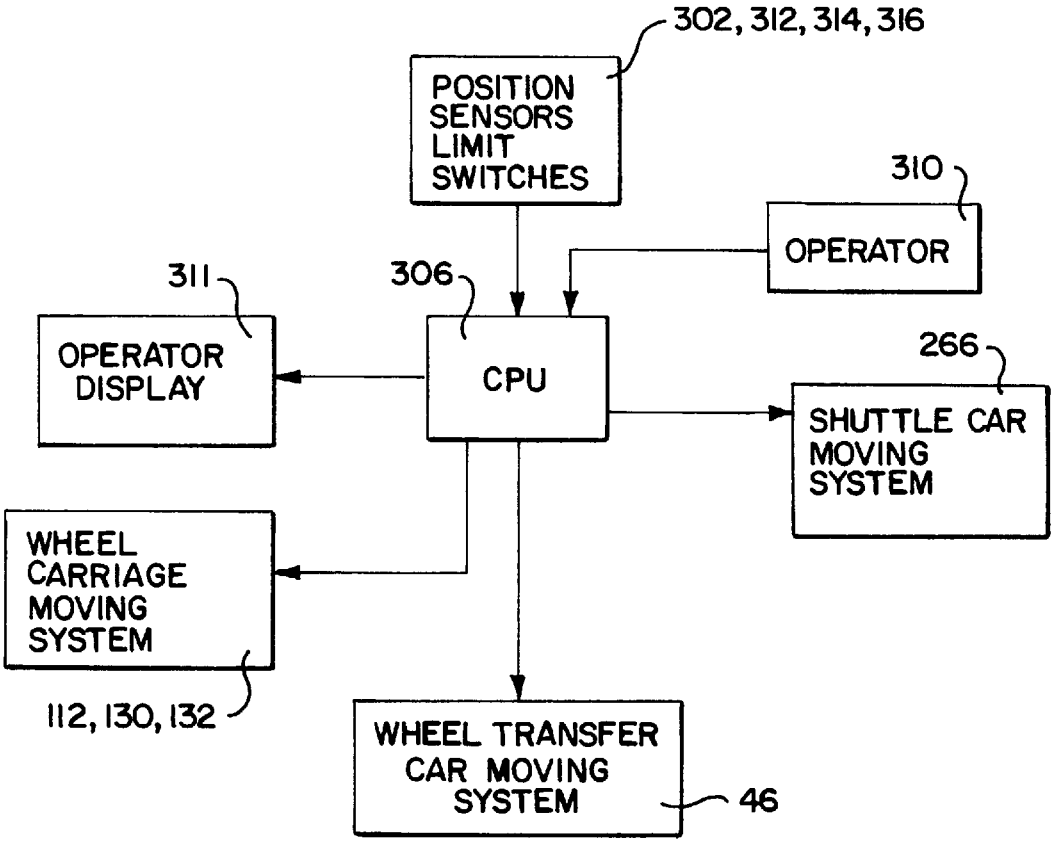
FIG. 14 is a flow chart illustrating examples of various inputs and outputs for the central processing unit that may be used to control the system of FIGS. 1–2.

The central processing unit 306 preferably is connected to control the wheel carriage moving means 112, the hoist raising and lowering means 130, 132, the wheel transfer car moving means 46 as well as the shuttle car moving means 266, and preferably is controllable by the operator at the final inspection station 12 so that the operator may direct the system to store a wheel in a particular shuttle car. The system may allow for direct operator input, shown with reference number 310 in FIG. 14, and may provide for an output display to the operator, shown with reference number 311 in FIG. 14. Safety features could be programmed into the system that would block any attempt to deliver a wheel to an improperly positioned shuttle car, as determined from feedback from the sensors 302. The central processing unit 306 could also control the shuttle car moving system 266 so that the shuttle cars are automatically moved a predetermined distance after receiving a wheel, and automatically return to a home position after the load of wheels is removed. The central processing unit 306 could also control the horizontal distance moved by the wheel hoist 90 in response to a direction by the operator to deliver the wheel to a particular shuttle car 16; the central processing unit can be used to ensure that the hoist consistently moves and is consistently aligned with at the appropriate drop off station. If desired, a system of limit switches or sensors and targets can be employed with the carriage system and the central processing unit to monitor the lateral position of the hoist on the horizontal beam; input from such devices are designated with reference number 312 in FIG. 14. Similarly, if desired, a system of limit switches or sensors and targets can be employed on the vertically movable and vertically stationary parts of the hoist to monitor the relative vertical positions of the hoist parts; input from such devices are designated with reference number 314 in FIG. 14. A similar system of limit switches or sensors and targets could also be used with the transfer car 14; input from such devices are designated with reference number 316 in FIG. 14. Any of the sensors and targets can be set to provide feedback for control of the various moving systems. For any of the moving parts of the system limit or proximity switches may be used to provide input to the programmable logic controller or central processing unit, and for control of the moving parts of the system. Suitable switches may be set up in accordance with standard electrical engineering practices.

A suitable central processing unit or computer is available from the Allen-Bradley Co. of Milwaukee, Wis. under the designation SLC-500. Suitable software for use with that central processing unit to accomplish the above-described functions is built in this processing unit. It should be understood that this central processing unit is identified for purposes of illustration only; other devices may be used to receive input from and control the various parts of the system.

In use of the system 10, the operator determines criteria, such as circumference, to use on sorting wheels, and assigns a category to each of the five wheel shuttle cars 16*a*–16*e*. At the fmal inspection station 12, the wheel is supported on its tread on the production line main rail 34, with the axis of the wheel hub opening positioned generally horizontally. The operator measures and inspects the wheel to determine the characteristics of the wheel. The operator determines the appropriate category for the wheel, thereby determining which shuttle car 16*a*–16*e* should receive the wheel. The operator may then enter a direction into the central processing unit 306. For a more sophisticated system, the operator or a machine such as a scanner may simply input data about the wheel, and the central processing unit could determine which shuttle car 16*a*–16*e* should receive the wheel. The central processing unit could be pre-programmed with categories for each of the five shuttle cars, or the categories could be selected from a menu by the operator.

The wheel transfer car 14 is initially in the wheel loading position at the transfer station where its main rail 30 is aligned with the production line rail 34. Each shuttle car 16*a*–16*e* is in an initial position where an empty slot or wheel receiving station 250 is aligned with one of the wheel drop off stations 19*a*–19*e*. The sensors 302 and targets 300 may be used as guides for positioning each shuttle car 16*a*–16*e* or as a fail safe mechanism to ensure that the receiving stations 250 are all properly positioned. To start the process, the operator moves the wheel 13 from the production line rail 34 to the wheel transfer car main rail 30, such as by rolling the wheel, with the tread of the wheel supported on the transfer car rail 30. When the wheel is received in the transfer car, the axis of the axle hole 86 is generally horizontally disposed and points toward the beam 96. The transfer car 14 and wheel 13 are moved from the transfer station 15 to the pick up station 17: in the illustrated embodiment, this movement is accomplished by pulling the telescoping rod 50 into the hydraulic cylinder 48, thereby pulling the wheel transfer car and wheel away from the wheel loading position at the wheel transfer station 15 adjacent the final inspection station 12 and toward the wheel pick up station or position 17 under the main frame 92. Movement of the transfer car and wheel may be controlled by the central processing unit 306.

Figure 15:
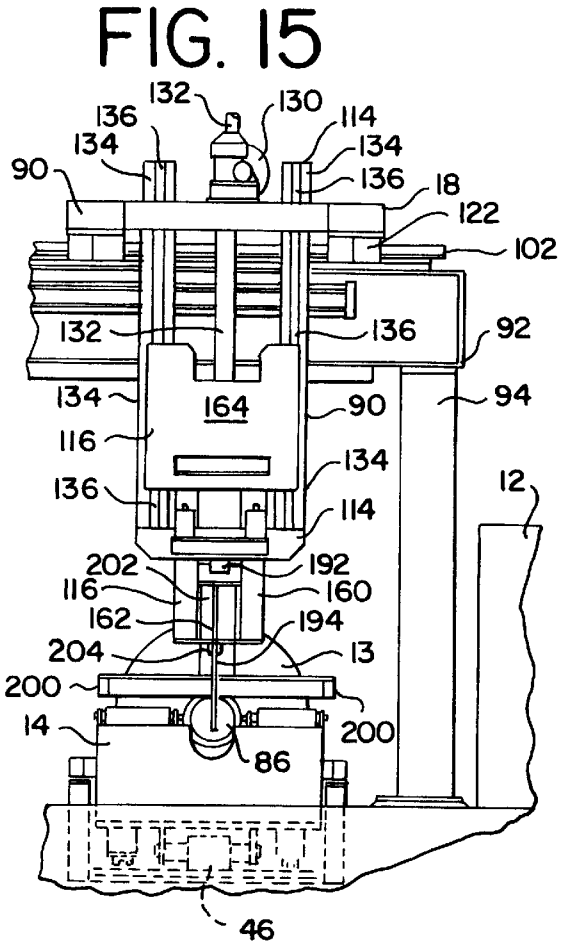
FIG. 15 is an elevation of a portion of the automated wheel sorting system, showing the hook of the hoist in the lowered position to receive a wheel at the wheel pick up station.

Before the wheel transfer car has reached the wheel pick up station, the central processing unit 306 has directed the wheel hoist to 90 to move to the wheel pickup station 17, and the motor 130 is actuated to turn the actuator 132 to lower the vertically movable portion 116 of the hoist 90 to a predetermined position wherein the horizontal portion 196 and free end 199 of the hook 162 are at the level of the wheel axle hole 86 when the wheel is supported on the rail 30 of the transfer car; the horizontal part 196 of the hook is aligned with the central axis of the axle hole 86, as shown in FIG. 15. The free end 199 of the hook 162 faces or points toward the wheel transfer car 14, and the free end 199 and horizontal part 196 of the hook 162 are horizontally and vertically aligned with the axle hole 86 of the wheel 13 in the transfer car 14; the axle hole 86 is free from any interference by any structural part of the transfer car. Thus, when the wheel transfer car 14 is pulled back to the wheel pick up station 17, the free end 199 of the hook 162 enters and passes through the wheel axle hole 86 and the horizontal part 196 of the hook is received and remains in the wheel axle hole 86.

Figure 17:
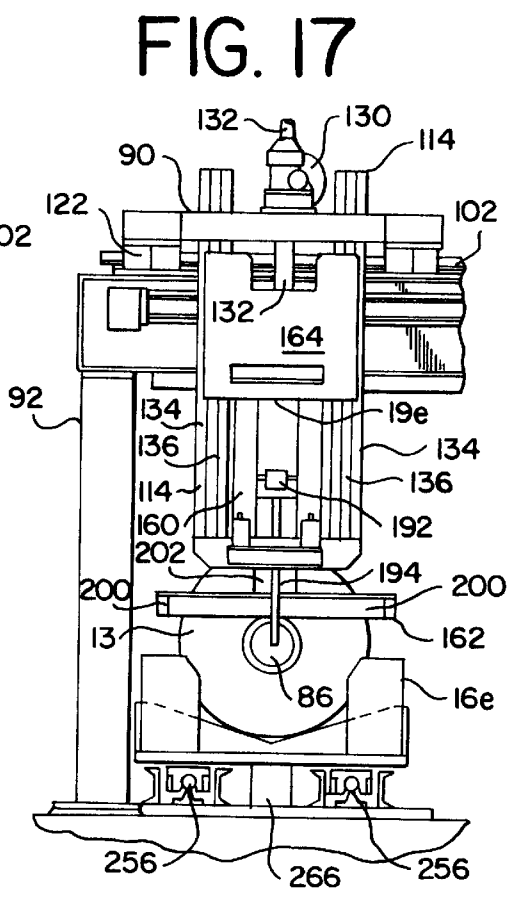
FIG. 17 is an elevation of a portion of the automated wheel sorting system, showing the hook of the hoist carrying a wheel in the lowered position at one of the wheel drop off stations.
Figure 16:
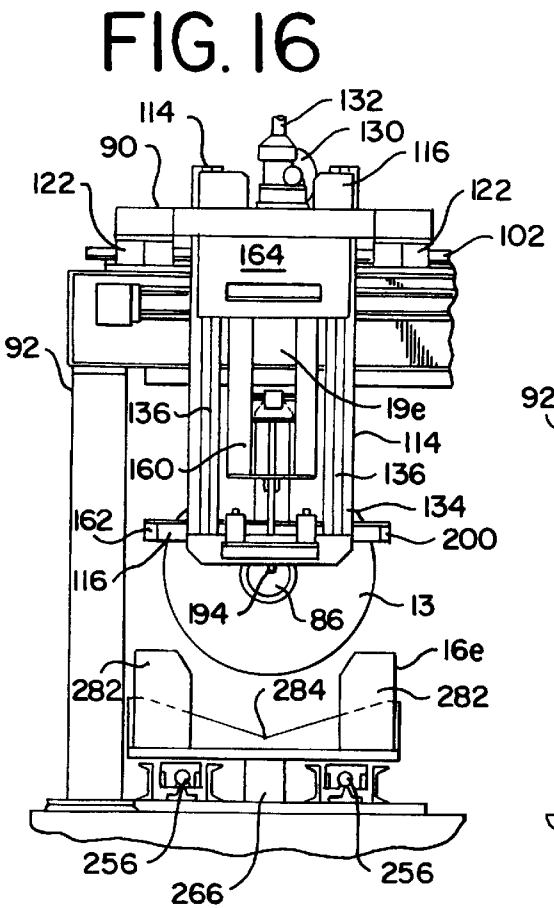
FIG. 16 is an elevation of a portion of the automated wheel sorting system, showing the hook of the hoist carrying a wheel in the raised position at one of the wheel drop off stations.

After the horizontal part 196 of the hook 162 has been received in the wheel axle hole 86, the central processing unit 306 actuates the motor 130 to turn the ball screw actuator 132 to raise the vertically movable portion 116 of the hoist 90. As the vertically movable portion 116 is raised, the wheel 13 is removed or lifted from the wheel transfer car 14. The central processing unit 306 actuates the linear drive mechanism 112, which moves the adaptor plate 144. One of the adaptor plate bumper contact angles 146 contacts one of the bumpers 142 on the hoist 90, moving the hoist 90 and wheel 13 horizontally along the horizontal beam 96 toward the wheel drop off stations 19*a*–19*e* and aligned shuttle cars 16*a*–16*e*. Depending on the characteristics of the wheel or other directions entered by the operator, the central processing unit 306 directs the linear drive mechanism 112 to move a predetermined distance and to stop the hoist 90 and wheel 13 at one of the wheel drop off stations 19*a*–19*e*, where the wheel 13 supported on the horizontal part 196 of the hook 162 is aligned over one of the receiving stations or slots 250 of the shuttle cars 16, as shown in FIG. 16. After the hoist and wheel have stopped moving, the central processing unit 306 again actuates the motor 130 on the hoist 90, to actuate the ball screw 132 to lower the vertically movable portion 116 of the hoist and the wheel until a preselected vertical height is reached wherein the wheel is deposited at rest on the support surface 281 of the wheel support 280 in the slot 250 of the shuttle car, as shown in FIG. 17. After the wheel is seated in the shuttle car slot 250, the central processing unit 306 directs the shuttle car moving system 266 to index the shuttle car 16 back away from the hoist 90, so that the horizontal part 196 and free end 199 of the hook 162 are no longer within the wheel axle hole 86, and the wheel and hook of the hoist are freed from one another and an empty receiving station 250 is now aligned with that drop off station 19. As the shuttle indexes, it moves from the side of the beam 96 opposite the inspection station 12 to the same side of the beam as the inspection station. The central processing unit 306 then again actuates the motor 130 to reverse the ball screw actuator 132 to raise the vertically movable portion 116 of the hoist 90 and to actuate the linear drive mechanism 112 to return the hoist 90 to the wheel pick up station 17 where it will receive the next wheel from the wheel transfer car 14. The process continues, with wheels being sorted and transported to appropriate locations, the shuttle cars indexing back as shown in FIG. 1 to the positions shown for shuttle car 16*b*, then 16*a*, then 16*c*, and intermediate positions, the shuttle car finally indexing to the position of shuttle car 16*e*, where the shuttle car is filled with five wheels. When the wheels are received in the shuttle car slots 250, the wheels are substantially upright with their treads 31 supported on the support surface 281, and the axle holes 86 of the wheels all have substantially horizontally disposed axes. The horizontally-disposed axes of the wheels in each shuttle car are aligned to be substantially co-linear. When the wheels are so aligned, the wheel axle holes 86 are free from any interference by a structural portion of the shuttle car. Then, the operator may signal another worker to drive a lift truck 241 up and insert the lift rod or ram 243 through the aligned wheel axle holes 86 as shown in FIG. 1 to lift the five wheels from the shuttle car to a height beyond interference by the support 280 or uprights 282, and transport the raised wheels to a designated location. The central processing unit 306 or some other mechanism may be used to direct the shuttle car moving system 266 to return the shuttle car to its home position, shown as the position of shuttle car 16*d* in FIG. 1, wherein the back slot 250 is vertically aligned beneath the horizontal beam 96 and wheel drop off station 19*d*.

Preferably, the system accelerates and decelerates smoothly, and move at a slow enough pace to minimize damage to the system components from sudden changes in velocity. If some misalignment occurs, the hook can be hit or even knocked off of the vertically movable part of the hoist, but since the hook is hung from the remainder of the hoist, the remaining components should be undamaged.

While only a specific embodiment of the invention have been described and shown, those in the art should recognize that various modifications and additions can be made thereto and alternatives can be used. In addition, it should be recognized that the present invention has applications beyond the illustrated environment. It is, therefore, the intention in the appended claims to cover all such modifications, additions, alternatives and applications as may fall within the true scope of the invention.

We claim:

1. A method of sorting articles into groups of like articles comprising the steps of:

providing an inspection station for inspecting and determining the category of the articles;

providing a pick-up station spaced from the inspection station;

providing a transfer device for moving the articles to the pick-up station;

providing a plurality of drop-off stations spaced from the pick-up station and inspection station;

providing a plurality of shuttle cars each having a plurality of receiving stations for receiving an article, each shuttle car being associated with one drop off station, each shuttle car and associated drop off station corresponding with a category of articles;

providing a carriage device for moving each article from the pick-up station to one of the drop off stations;

aligning a single receiving station of each shuttle car with each drop off station;

inspecting an article at the inspection station;

determining the appropriate category for the inspected article;

moving the article from the inspection station to the transfer device;

moving the article and transfer device to the pick-up station;

removing the article from the transfer device at the pick up station and moving the article to the drop off station corresponding with the category for the article;

depositing the article in the receiving station of the shuttle car aligned with the drop off station and corresponding with the category of the article; and moving the shuttle car so that an empty receiving station is aligned with the drop off station.

2. The method of claim 1 wherein the carriage device comprises an overhead beam extending between the pick-up station and each drop off station, the carriage device further comprising a hoist movable on the beam back and forth between the pick-up station and the drop off stations, the hoist having a vertically fixed portion and a vertically movable portion mounted on the vertically fixed portion, wherein:

the step of removing the article from the transfer device at the pick up station includes the step of lowering the vertically movable portion of the hoist at the pick up station before the step of moving the article and transfer device to the pick up station and the step of raising the vertically movable portion of the hoist to lift the article out of the transfer device after the step of moving the article and transfer device to the pick up station;

the step of moving the article to the drop off station corresponding with the category of the article includes the step of moving the two portions of the hoist along the beam;

the step of depositing the article at the drop off station corresponding with the category of the article in the receiving station of the shuttle car aligned with the drop off station includes the step of lowering the vertically movable portion at the drop off station to settle the article in the shuttle car receiving station and raising the vertically movable portion after the step of moving the shuttle car so that an empty receiving station is aligned with the drop off station; and the step of moving the shuttle car so that an empty receiving station is aligned with the drop off station includes the step of moving the filled shuttle car receiving station away from the vertically movable portion of the hoist to free the article from the hoist.

3. The method of claim 2 wherein the hoist accelerates from the pick up station and decelerates before reaching the drop off station, the acceleration and decelerations being at rates minimizing shock to the carriage device from the momentum of the article.

4. The method of claim 2 wherein the articles comprise railroad wheels having treads, hubs and axle holes in the hubs, the vertically movable part of the hoist including a hook having a portion under the beam and a free end, wherein the step of moving the article from the inspection station to the transfer device includes positioning the wheel in the transfer device so that the axis of the axle hole is substantially horizontally disposed and directed toward the hook of the hoist;

wherein the step of lowering the vertically movable portion of the hoist at the pick up station includes aligning the free end of the hook with the axis of the axle hole so that when the article and transfer device are moved to the pick up station a portion of the hook is received in the axle hole.

5. The method of claim 4 wherein the axles holes of the wheels held in each shuttle car have substantially horizontally aligned axes and further comprising the step of removing the sorted wheels from one shuttle car by inserting a lift rod through the aligned axle holes of the wheels, lifting the rod a distance sufficient to lift the wheels from the shuttle car, and transporting the wheels to a remote storage location.

6. A system for sorting articles into groups of like articles comprising:

an inspection station for determining the category to which an article belongs;

a pick up station spaced from the inspection station;

a plurality of drop off stations laterally spaced from the pick up station;

a movable transfer car for moving an article to the pick up station;

a carriage system including a hoist laterally movable between the pick up station and drop off stations, the hoist having a vertically movable portion for raising an article out of the transfer car at the pick up station;

a plurality of shuttle cars spaced from the inspection station and pick up station, each shuttle car being associated with one drop off station, each shuttle car having a plurality of receiving stations for receiving sorted articles, one receiving station in each shuttle car being aligned with each drop off station so that the vertically movable portion of the hoist may be lowered to deposit an article in the receiving station;

means for moving the transfer car from the inspection station to the pick up station;

means for moving the shuttle cars so that each receiving station may be aligned with the corresponding carriage system drop off station;

means for moving the hoist laterally between the pick-up station and the drop off stations; and means for raising and lowering the vertically movable portion of the hoist.

7. The system of claim 6 wherein the carriage system includes a beam spanning the distance between the transfer car and all of the shuttle cars, the beam being positioned substantially above the pick up station of the transfer car and substantially above the receiving stations of the shuttle cars, the inspection station being on one side of the beam, a shaft supported by the beam and a cam track surface supported by the beam, the hoist including rolling means on the shaft and a cam roller bearing against the cam track surface, the hoist further including a hook having a portion under the beam and a free end, the cam track surface being between the cam roller and the inspection station.

8. The system of claim 7 wherein the hoist includes a vertically movable portion and a vertically fixed portion, the vertically movable portion including a reciprocating part mounted for vertical movement on the vertically fixed portion, the hook being removably suspended from the reciprocating part.

9. The system of claim 8 wherein the reciprocating part of the hoist is on the side of the beam opposite the inspection station.

10. The system of claim 6 wherein the system is useful for moving railroad wheels having treads and hubs with central axle holes, wherein each shuttle car has a support surface shaped to support the tread of the wheel and to limit rolling movement of the wheel.

11. The system of claim 6 wherein the carriage system includes a linear drive mechanism, an adaptor attached for direct drive by the linear drive mechanism, bumper means attached to the hoist and juxtaposed with the adaptor so that the hoist may be moved indirectly through movement of the adaptor and action of the adaptor against the bumper means.

12. The system of claim 6 wherein the carriage system includes a beam spanning the distance between the transfer car and all of the shuttle cars, the beam being positioned substantially above the pick up station of the transfer car and substantially above one receiving station of each shuttle car, wherein each shuttle car is movable in a direction perpendicular to the beam, the shuttle cars moving from a position below and on one side of the beam to a position below and on the opposite side of the beam as the shuttle cars fill with articles.

13. The system of claim 12 wherein the inspection station is on one side of the beam and the shuttle cars move from the side of the beam opposite the inspection station to the same side of the beam as the inspection station as the shuttle cars fill with articles.

14. The system of claim 6 wherein each shuttle car is for receiving and holding a plurality of railroad wheels of the type having a tread and a central hub with an axle hole through the hub, the axle holes having substantially horizontal axes when received in the receiving stations of the shuttle cars, the substantially horizontal axes being substantially aligned when the railroad wheels are received in the receiving stations of the shuttle car, the axle holes being free from any interference by a structural portion of the shuttle car.

15. The system of claim 6 further comprising a central processing unit connected to control the means for moving the shuttle cars, the system further comprising sensors connected to provide input to the central processing unit as to the position of each shuttle car.

16. The system of claim 6 wherein the article to be sorted comprises railroad wheels having treads and the transfer car has a transfer station adjacent the inspection station and the inspection station and the transfer car have support structures that are substantially co-linear when the transfer car is positioned at the transfer station so that a railroad wheel may be supported on its tread in the inspection station and rolled on its tread to the transfer car where the wheel is supported on its tread.

17. A system for sorting railroad wheel into groups of like wheels, the wheels being of the type having outer treads and hubs with axle holes, the system comprising:

an inspection station for determining the category to which a wheel belongs, the inspection station including a rail for supporting a tread of the wheel;

a transfer station adjacent the inspection station;

a pick up station spaced from the inspection station and transfer station;

a plurality of drop off stations spaced from the inspection station, transfer station and pick up station;

a transfer car movable between the transfer station and the pick-up station, the transfer car having a rail aligned with the rail of the inspection station when the transfer car is at the transfer station so that a wheel may be rolled on its tread from the rail of the inspection station onto the rail of the transfer car;

a carriage system including a hoist for raising a wheel out of the transfer car at the pick up station, the carriage system having a substantially horizontal beam spanning the distance between the pick up station and all of the drop off stations, the beam being positioned above the pick up station, the hoist being movable on the beam between the pick up station and drop off stations, the hoist including a vertically movable portion movable between positions nearer to and farther from the beam;

a plurality of shuttle cars spaced from the inspection station, the transfer station and the pick up station, each shuttle car being associated with one drop off station for the carriage system, each shuttle car having a plurality of receiving stations for receiving sorted wheels, one receiving station in each shuttle car being aligned with each carriage system drop off station and below the beam so that the hoist may be lowered to deposit a wheel in the receiving station;

means for moving the transfer car from the transfer station to the pick up station;

means for moving the shuttle cars so that each receiving station may be aligned with the corresponding carriage system drop off station;

means for moving the hoist between the pick-up station and the drop off stations; and means for raising and lowering the vertically movable portion of the hoist.

18. The system of claim 17 wherein each shuttle car is for receiving and holding a plurality of wheels in a substantially upright position with the axles holes of the wheels substantially aligned and free from any interference by a structural portion of the shuttle car.

19. The system of claim 17 wherein the carriage system includes a linear drive mechanism, an adaptor attached for direct drive by the linear drive mechanism, bumper means attached to the hoist and juxtaposed with the adaptor so that the hoist may be moved indirectly through movement of the adaptor and action of the adaptor against the bumper means.

20. The system of claim 17 wherein the transfer station is on one side of the beam and the carriage system includes a shaft supported by the beam and a cam track surface supported by the beam, the hoist including rolling means on the shaft and a cam roller bearing against the cam track surface, the vertically movable portion of the hoist further including a hook having a portion under the beam and a free end, the cam track surface being between the cam roller and the transfer station.

21. The system of claim 20 wherein the transfer car holds the wheel and the vertically movable portion of the hoist can be positioned so that the free end of the hook is aligned with the axle hole of the wheel so that the free end of the hook may enter and pass through the axle hole of the wheel when the wheel and transfer car are moved from the transfer station to the pick up station.

22. The system of claim 20 wherein the hoist includes a vertically fixed portion and the vertically movable portion of the hoist includes a reciprocating part mounted for movement on the vertically fixed portion, wherein the hook is removably suspended from the reciprocating portion.

23. The system of claim 22 wherein the reciprocating part of the hoist is on the side of the beam opposite the transfer station.

* * * * *